US008436782B2

(12) United States Patent
Sugiyama et al.

(10) Patent No.: US 8,436,782 B2
(45) Date of Patent: May 7, 2013

(54) COMMUNICATION ANTENNA DEVICE

(75) Inventors: Tomonori Sugiyama, Shizuoka (JP); Naohiro Matsushita, Shizuoka (JP); Masakazu Kato, Shizuoka (JP); Sadatoshi Oishi, Shizuoka (JP); Jun Yaginuma, Shizuoka (JP); Sunao Tsuchida, Shizuoka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 274 days.

(21) Appl. No.: 12/864,719

(22) PCT Filed: Feb. 5, 2009

(86) PCT No.: PCT/JP2009/051971

§ 371 (c)(1),
(2), (4) Date: Jul. 27, 2010

(87) PCT Pub. No.: WO2009/113343

PCT Pub. Date: Sep. 17, 2009

(65) Prior Publication Data

US 2011/0156985 A1 Jun. 30, 2011

(30) Foreign Application Priority Data

Mar. 13, 2008 (JP) ..... 2008-064373

(51) Int. Cl.
*H01Q 1/12* (2006.01)

(52) U.S. Cl.
USPC ..... 343/891; 343/853; 343/767; 343/893

(58) Field of Classification Search ..... 343/900, 343/715, DIG. 1, 892–895, 904, 906, 878, 343/884, 888; 455/430, 427, 428, 426, 512, 455/513, 98, 12.1, 13.1, 13.3, 456; 370/277, 370/281, 296, 328, 343, 329
See application file for complete search history.

(56) References Cited

U.S. PATENT DOCUMENTS

| | | | | |
|---|---|---|---|---|
| 5,548,815 | A | 8/1996 | Takayama et al. | |
| 5,604,972 | A * | 2/1997 | McCarrick | 29/600 |
| 6,208,859 | B1 * | 3/2001 | Halvorson | 455/430 |

FOREIGN PATENT DOCUMENTS

| | | |
|---|---|---|
| JP | 07-221680 | 8/1995 |
| JP | 2000-011294 | 1/2000 |

(Continued)

OTHER PUBLICATIONS

International Search Report for PCT.JP2009/051971 mailed on May 12, 2009.

*Primary Examiner* — Shawki Ismail
*Assistant Examiner* — Christopher Lo
(74) *Attorney, Agent, or Firm* — Turocy & Watson, LLP

(57) ABSTRACT

A communication antenna device for use in radio communication between a moving body and an access point comprises an antenna main body for transmitting and receiving a signal, a base side member of the moving body for supporting the antenna main body, and a damping mechanism provided between the base side member and the antenna main body and suppressing high frequency vibration of the antenna main body that has an impact on the radio communication. The damping mechanism includes an elastic member for absorbing high frequency vibration that has an impact on the radio communication. The elastic member has such characteristics as absorbing high frequency vibration of the antenna main body that makes changes in amplitude or frequency of a transmission signal from the antenna main body to the extent of inducing a demodulation error when the transmission signal is received at an antenna of the other party.

2 Claims, 8 Drawing Sheets

FOREIGN PATENT DOCUMENTS

| | | |
|---|---|---|
| JP | 2000-175302 | 6/2000 |
| JP | 2003-013932 | 1/2003 |
| JP | 2003-332827 | 11/2003 |
| JP | 2004-251844 | 9/2004 |

* cited by examiner

• 802.11a FRAME CONFIGURATION

| STS (SHORT TRAINING SYMBOL) | LTS (LONG TRAINING SYMBOL) | SIGNAL (SIGNAL LENGTH, MODULATION SYSTEM INFORMATION) | DATA |
|---|---|---|---|

PREAMBLE — PAYLOAD

ABOUT 250 μs※

※ TIME LENGTH WHEN LINK RATE IS 54Mbps
(IT DIFFERS WITH LINK RATE.)

(A)

(B)

(A)

(B)

COMMUNICATION ANTENNA DEVICE

TECHNICAL FIELD

The present invention relates to a communication antenna device for use in radio communication and more specifically relates to a communication antenna device that has overcome lowering of communication quality caused by vibration.

BACKGROUND ART

A radio communication system comprising a moving body moving along a moving route and an access point performing radio communication with the moving body with use of leaky transmission lines provided along the moving route of the moving body is generally known.

In such a radio communication system, communication is performed between the moving body and the access point while the moving body moves with a predetermined space from the leaky transmission lines.

An example of this radio communication system is Patent Document 1.

Patent Document 1: Japanese Patent Laid-Open No. 2000-11294

DISCLOSURE OF THE INVENTION

Problems to be Solved by the Invention

In such a conventional radio communication system, communication is performed between an antenna mounted on a moving body such as a vehicle moving along leaky transmission lines and the leaky transmission lines, and the communication quality will not be lowered under a normal use state.

However, in a case where the antenna suffers high frequency vibration when the moving body moves in packet communication, a communication error occurs in some cases. This will be explained below.

In packet communication, a packet having a frame configuration as shown in FIG. 2 is used. It is noted that FIG. 2 is an example of an 802.11a frame configuration. As shown in the figure, a packet consists of a preamble section and a payload section. Here, time length when link rate is 54 Mbps is about 250 μs per packet. It is noted that the time length per packet differs with link rate and data size.

The preamble section consists of an STS (short training symbol) and an LTS (long training symbol). The payload section consists of a signal section containing signal length, modulation system information, etc. and a data section containing the main body of information to be transmitted.

In the packet communication with use of the packet having the aforementioned frame configuration, packet signal detection, timing detection (synchronization), carrier frequency error correction and correction of a reference amplitude and a phase are performed by using the preamble section.

Meanwhile, the aforementioned antenna of the moving body makes parallel movement with a predetermined space from the leaky transmission lines, and when the antenna vibrates along with movement of the moving body, the space between the antenna and the leaky transmission lines may change due to high frequency vibration of the antenna. In this case, when packet communication is performed while the antenna suffers high frequency vibration, amplitude and frequency of a signal to be received at the antenna may change. Then, the change in amplitude and frequency of the signal may cause an error between the reception signal and the value in the aforementioned preamble section, which may cause a demodulation error. The occurrence of the demodulation error leads a problem of lowering of communication quality.

Means to Solve the Problems

To solve the aforementioned problem, a communication antenna device according to the present invention, in a radio communication system having a first communication device and a second communication device that move relatively and a leaky transmission line provided at one communication device, facing the leaky transmission line and provided at the other communication device to perform radio communication, comprises an antenna main body for transmitting and receiving a signal to and from the leaky transmission line, a base side member of the communication device for supporting the antenna main body, and a damping mechanism provided between the base side member and the antenna main body and suppressing high frequency vibration of the antenna main body that has an impact on the radio communication in a radio wave radiation direction of the leaky transmission line.

The first communication device and the second communication device preferably move relatively with a predetermined range of space from each other. The damping mechanism preferably includes an elastic member for absorbing high frequency vibration that has an impact on the radio communication. The elastic member preferably has such characteristics as absorbing high frequency vibration of the antenna main body that makes changes in amplitude or frequency of a transmission signal from the leaky transmission line to the extent of inducing a demodulation error when the transmission signal is received at the antenna main body.

Effect of the Invention

It is possible to prevent lowering of communication quality caused by vibration along with movement of a moving body.

EXPLANATIONS OF REFERENCE NUMERALS

11 radio communication system, 12 moving body, 13 access point, 14 leaky transmission line, 15 terminal, 17, 18 directional antenna, 19 radio communication terminal, 20 combining unit, 21 directional antenna, 23 damping mechanism, 24 base side member, 25 supporting bracket, 25A base end side member, 25B tip end side member, 27 base end side plate portion, 28 tip end side plate portion, 29 elastic member

BEST MODE FOR CARRYING OUT THE INVENTION

Hereinafter, an embodiment of the present invention will be described with reference to the attached drawings. A communication antenna device according to the present embodiment is a device used in a radio communication system. In the following description, an entire radio communication system including the communication antenna device will be explained.

Figure 3:
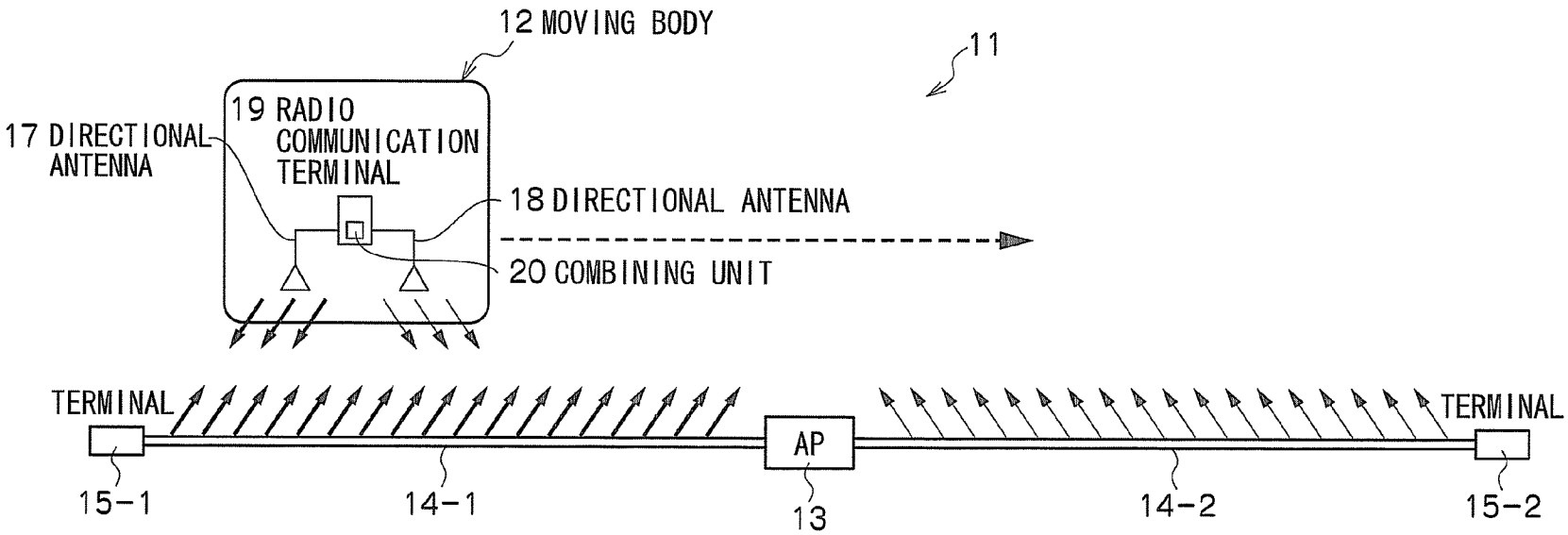
FIG. 3 is a schematic view showing a radio communication system according to the embodiment of the present invention.

This radio communication system 11 mainly comprises a moving body 12, an access point (AP: Access Point) 13, leaky transmission lines 14 (14-1 and 14-2) and terminals 15 (15-1 and 15-2) connected to the leaky transmission lines 14 (14-1 and 14-2) as shown in FIG. 3. The moving body 12 and the access point 13 respectively constitute a first communication device and a second communication device that move relatively.

The moving body 12 moves along a predetermined route, and the leaky transmission lines 14-1 and 14-2 are extended along the moving route of the moving body 12. Thus, the moving body 12 moves along the leaky transmission lines 14-1 and 14-2. To the moving body 12, a vehicle such as an automated guided vehicle, a movable robot or the like can be applied for example.

The moving body 12 comprises at least directional antennas 17 and 18 and a radio communication terminal 19. In the moving body 12, the radio communication terminal 19 is connected to each of the directional antennas 17 and 18. Further, the radio communication terminal 19 has a combining unit 20 (e.g., combining diversity) controlling reception radio waves of the two directional antennas 17 and 18. Thus, since it can combine reception radio waves of the two directional antennas 17 and 18, fluctuation in reception levels can be reduced. The directional antennas 17 and 18 are antenna devices having different directional characteristics from each other, and planar antennas, Yagi antennas or the like can be applied to them for example. To the radio communication terminal 19, one used in an existing system can be applied. To the combining unit 20, various existing techniques can be widely applied.

The directional antenna 17 has directional characteristics of being opposed to a radio wave radiation direction of the leaky transmission line 14-1 while the directional antenna 18 has directional characteristics of being opposed to a radio wave radiation direction of the leaky transmission line 14-2. Further, these directional antennas 17 and 18 do parallel movement with a predetermined space such as 50 cm to 1 m or so from the leaky transmission lines 14-1, 14-2.

Here, differences in reception levels in a case where the directional direction of the directional antenna is opposed to the radio wave radiation direction of the leaky transmission line and in a case where it is not opposed to it will be described with reference to FIGS. 4 and 5.

Figure 4:
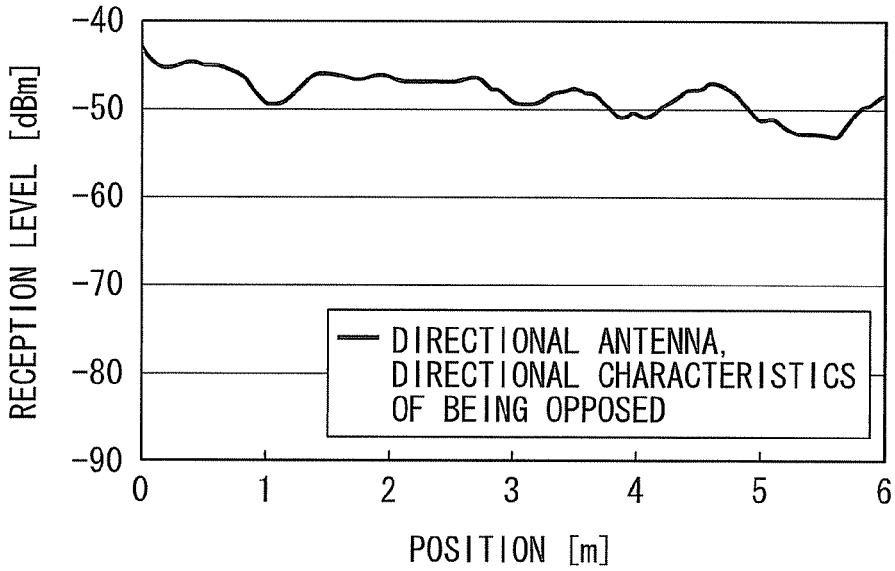
FIG. 4 shows reception levels in a case where the directional direction of a directional antenna is opposed to the radio wave radiation direction from a leaky transmission line.
Figure 4:
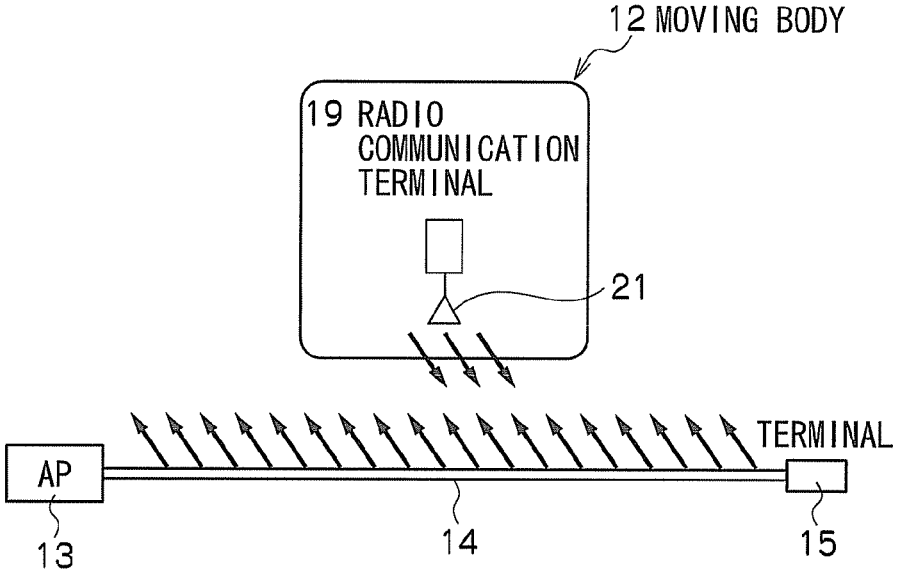
Figure 5:
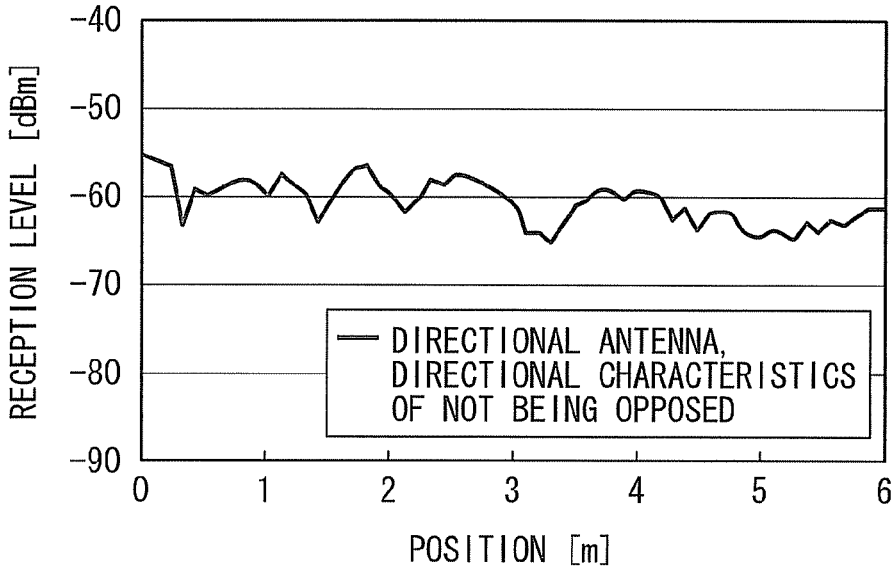
FIG. 5 shows reception levels in a case where the directional direction of a directional antenna is not opposed to the radio wave radiation direction from a leaky transmission line.
Figure 5:
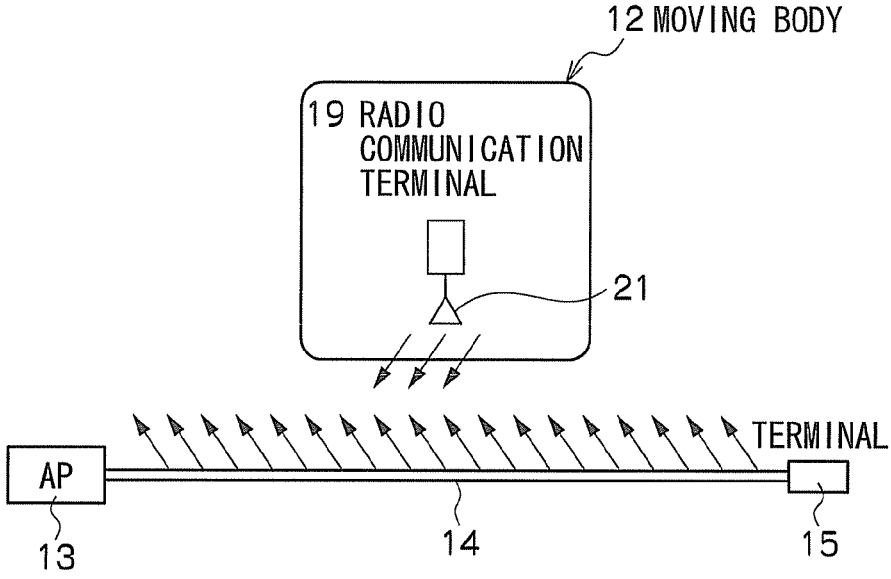

FIGS. 4 and 5 are schematic views explaining reception levels at a directional antenna 21 of the moving body 12. It is noted that FIGS. 4 and 5 show changes in reception levels in a case where the moving body 12 comprises only one directional antenna for convenience of explanation.

FIG. 4 shows a case where the directional direction of the directional antenna 21 is opposed to the radio wave radiation direction from the leaky transmission line 14. FIG. 5 shows a case where the directional direction of the directional antenna 21 is not opposed to the radio wave radiation direction from the leaky transmission line 14.

Referring to FIGS. 4 (A) and 5 (A), in a case where the directional antenna 21 has directional characteristics of being opposed to the radio wave radiation direction of the leaky transmission line 14 as in FIG. 4 (A), the reception levels in the moving body 12 are relatively high and have a relatively small variation range even when the moving body 12 moves parallel to the leaky transmission line 14. On the other hand, in a case where the directional antenna 21 has directional characteristics of not being opposed to the radio wave radiation direction of the leaky transmission line 14 as in FIG. 5 (A), the reception levels are relatively low and have a relatively large variation range.

Accordingly, providing the two directional antennas 17 and 18 respectively having directional characteristics of being opposed to the radio wave radiation directions of the leaky transmission line 14-1 and the leaky transmission line 14-2 lets the directional direction of the directional antenna 17 of the moving body 12 opposed to the radio wave radiation direction of the leaky transmission line 14-1 in a zone where the leaky transmission line 14-1 is passed therethrough and lets the directional direction of the directional antenna 18 of the moving body 12 opposed to the radio wave radiation direction of the leaky transmission line 14-2 in a zone where the leaky transmission line 14-2 is passed therethrough, which enables favorable communication.

Meanwhile, although a case of providing the two directional antennas 17 and 18 is illustrated here, three or more directional antennas may be provided in accordance with the conditions of extending and applying the leaky transmission lines 14-1 and 14-2.

These directional antennas 17 and 18 are supported on damping mechanisms 23 described later.

The access point 13 is a station device communicating with the radio communication terminal 19 comprised in the moving body 12 and is connected to one end of each of the two leaky transmission lines 14-1 and 14-2. That is, the access point 13 is connected to both the two leaky transmission lines 14-1 and 14-2, Connecting the access point 13 to the plural leaky transmission lines 14-1 and 14-2 in such a manner enables expansion of a communication area in which one access point 13 performs radio communication through the leaky transmission lines 14-1 and 14-2. It is to be understood that the access point 13 may be connected to three or more leaky transmission lines.

Each of the leaky transmission lines 14-1 and 14-2 is connected at one end to the common access point 13 as described above and is connected at the other end to the terminal 15-1 or 15-2. To each of the leaky transmission lines 14-1 and 14-2, a leaky transmission line used in an existing system such as a leaky coaxial cable (LCX: Leaky CoaXial Cable) and a leaky waveguide can be applied.

Also, for the two leaky transmission lines 14-1 and 14-2, leaky transmission lines of the same kind as each other are used basically, but leaky transmission lines of different kinds may be applied depending on the embodiment. Further, each of the leaky transmission lines 14-1 and 14-2 may be of the same or different kind(s) as or from a leaky coaxial cable (LCX) 2 comprised in the moving body 12.

The two leaky transmission lines 14-1 and 14-2 connected to the access point 13 are explained as ones extended from the access point 13 horizontally in opposite directions. There is not only the case where the respective leaky transmission lines 14-1 and 14-2 are extended horizontally in opposite directions, but there may also be a case where one leaky transmission line is extended in a vertical direction to another leaky transmission line or a case where one leaky transmission line is extended with a predetermined angle to another leaky transmission line.

Each of the aforementioned directional antennas 17 and 18 is supported on the side of a base side member 24 by the after-mentioned damping mechanism 23 and a supporting bracket 25. It is noted that the base side member 24 is a member on the side of the moving body 12 to support each of the directional antennas 17 and 18 and is a body frame or the like of the moving body 12.

The damping mechanism 23 is a mechanism to control vibration of each of the directional antennas 17 and 18. More specifically, it is a mechanism to control high frequency vibration of each of the directional antennas 17 and 18 in the radio wave radiation direction of the leaky transmission line 14-1. The constitution of the damping mechanism 23 is described in details below.

Figures 1, 2:
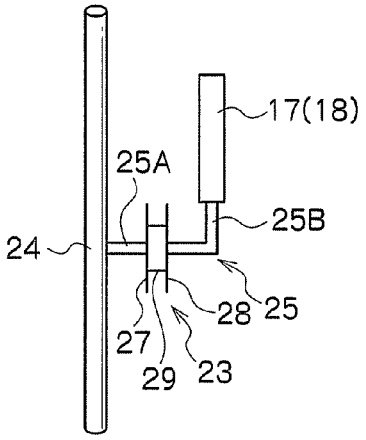
FIG. 1 is a side view showing a communication antenna device according to an embodiment of the present invention.
FIG. 2 is a schematic view showing a frame configuration example of a packet used in radio communication.
Figure 6:
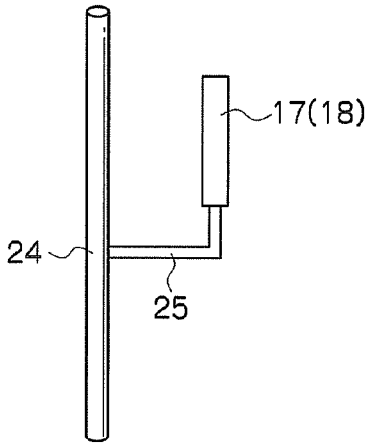
FIG. 6 is a side view showing a state where the directional antenna is directly attached to a base side member.

Each of the directional antennas 17 and 18 is attached to the base side member 24 via the damping mechanism 23 as shown in FIG. 1. That is, although each of the directional antennas 17 and 18 is conventionally attached to the base side member 24 with use of the supporting bracket 25 as shown in FIG. 6, the damping mechanism 23 is provided between the base side member 24 and each of the directional antennas 17 and 18 in the present embodiment to suppress the high frequency vibration of each of the directional antennas 17 and 18 to a non-problematic level.

The damping mechanism 23 is provided at an intermediate position of the supporting bracket 25 as a base member provided between the base side member 24 and each of the directional antennas 17 and 18. That is, the damping mechanism 23 is provided between a base end side member 25A and a tip end side member 25B of the supporting bracket 25. Specifically, the damping mechanism 23 is constituted by a base end side plate portion 27 attached to the tip end portion of the base end side member 25A of the supporting bracket 25, a tip end side plate portion 28 attached to the base end portion of the tip end side member 25B and an elastic member 29 attached between the base end side plate portion 27 and the tip end side plate portion 28.

For the aforementioned elastic member 29, a member that can absorb high frequency vibration is used. That is, for the elastic member 29 is used a member having characteristics of absorbing high frequency vibration of each of the directional antennas 17 and 18 that makes changes in amplitude or frequency of a transmission signal from the aforementioned leaky transmission line 14 to the extent of inducing a demodulation error when the transmission signal is received at each of the directional antennas 17 and 18 as an antenna main body. A specific example of this elastic member 29 is a material having a high function of absorbing high frequency vibration such as a natural rubber-based member, an elastic synthetic resin, gel or polymeric gel. Such a member undergoes component coordination so as to be set to have characteristics of absorbing vibration with target vibration frequency (high frequency vibration that makes changes in each of the directional antennas 17 and 18 to the extent of inducing a demodulation error) or higher and not allowing vibration with higher vibration frequency than the target vibration frequency. Meanwhile, it may be difficult in some cases for a member such as gel or polymeric gel to constitute the elastic member 29 by itself as a single member. In such a case, an elastic tubular member is filled with gel or the like to constitute the elastic member 29. For this tubular member, a material such as a flexible rubber is used.

Here, the aforementioned directional antennas 17 and 18, damping mechanism 23 and supporting bracket 25 constitute the communication antenna device.

The radio communication system constituted as above is operated as follows. It is noted that the communication antenna device part is mainly explained here since the operation of the entire system is similar to that of a conventional radio communication system.

The moving body 12, which is a vehicle such as an automated guided vehicle, a movable robot or the like, carries loads and does work with robot arms while moving along the leaky transmission lines 14-1 and 14-2 of the access point 13. At the same time, the moving body 12 performs communication while moving along the leaky transmission lines 14-1 and 14-2.

In the communication of the moving body 12 during movement, the directional antennas 17 and 18 may vibrate by vibration of the moving body 12 caused by movement of the moving body 12.

This vibration is transmitted from the base side member 24 of the moving body 12 via the supporting bracket 25 to each of the directional antennas 17 and 18 to cause each of the directional antennas 17 and 18 to vibrate. At this time, in the supporting bracket 25, the vibration is transmitted from the base end side member 25A to the damping mechanism 23, is suppressed to a non-problematic level at this damping mechanism 23, and is transmitted to the tip end side member 25B before it is transmitted to each of the directional antennas 17 and 18.

In the damping mechanism 23, the vibration transmitted from the base end side member 25A of the supporting bracket 25 is transmitted via the base end side plate portion 27 to the elastic member 29, is attenuated to have non-problematic frequency at this elastic member 29, and is transmitted to the tip end side plate portion 28 to cause each of the directional antennas 17 and 18 to vibrate with non-problematic frequency via the tip end side member 25B of the supporting bracket 25.

As a result of the above, even when each of the directional antennas 17 and 18 suffers high frequency vibration, an error between a reception signal and a value in the preamble section of the packet will not occur, which can prevent lowering of communication quality caused by a demodulation error. Consequently, favorable communication quality can be maintained.

TEST EXAMPLE

Figure 7:
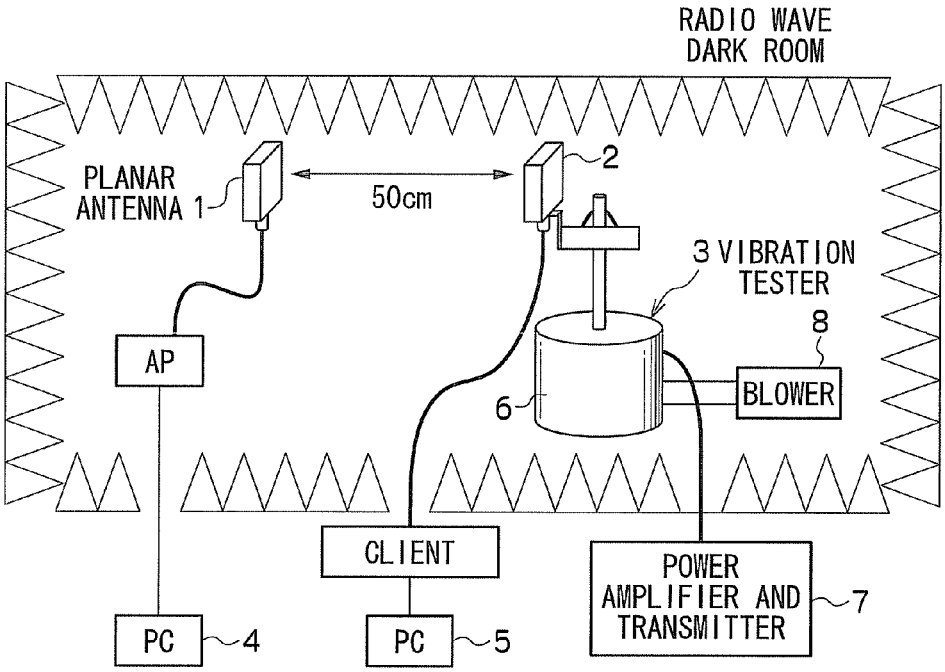
FIG. 7 is a block diagram showing a vibration test system.

Here, the result of a test of the relation between vibration frequency of a planar antenna and throughput is explained. In the test, the planar antenna was vibrated by means of a vibration tester to measure the throughput. Specifically, two planar antennas 1, 2 provided to face each other and a vibration tester 3 were mainly prepared as shown in FIG. 7. One planar antenna 1 corresponds to a leaky transmission line as an access point (AP) and is fixed in a test system. This planar antenna 1 is connected via the access point (AP) to a computer 4 that transmits a test signal.

The other planar antenna 2 corresponds to a moving body as a client and is attached to the vibration tester 3. This planar antenna 2 is connected via the client to a computer 5, and a signal received at the planar antenna 2 is processed at the computer 5.

The vibration tester 3 is a machine that supports and vibrates the other antenna 2 with high frequency. This vibration tester 3 comprises a vibrating unit 6, a power amplifier and transmitter 7 and a blower 8. The vibrating unit 6 is a vibration source to vibrate the planar antenna 2 directly. The power amplifier and transmitter 7 is a device to generate a frequency signal that vibrates the vibrating unit 6 and amplify the signal. The blower 8 is a device to send cooling air to the vibrating unit 6 and cool it. By this vibration tester 3, the other planar antenna 2 is vibrated with high frequency.

The aforementioned planar antennas 1, 2 and vibration tester 3 are housed in a radio wave dark room 9 to eliminate noise radio wave coming from outside.

Figure 8:
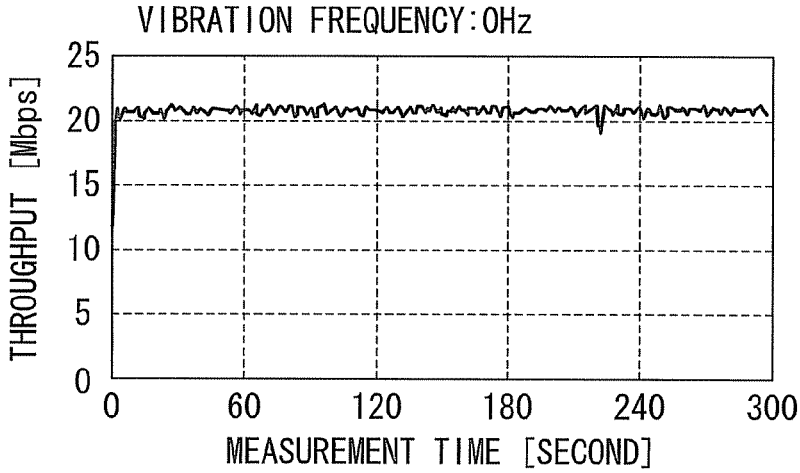
FIG. 8 is a graph showing the relation between throughput and measurement time when a test was performed with no vibration given to the directional antenna.
Figure 9:
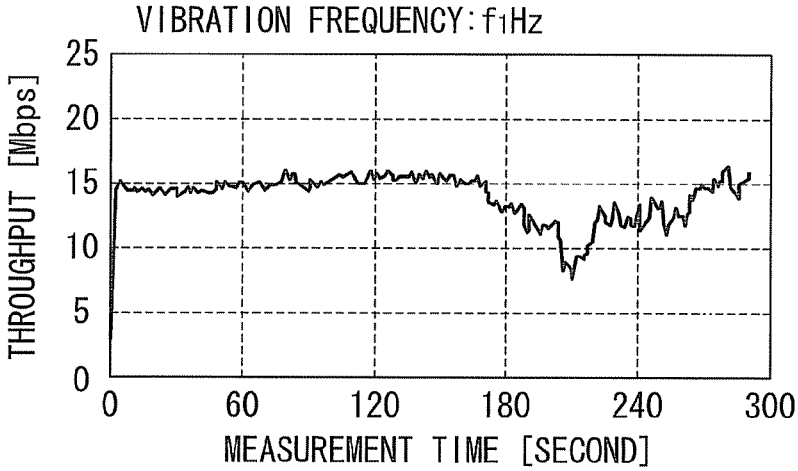
FIG. 9 is a graph showing the relation between throughput and measurement time when a test was performed with vibration of $f_1$ Hz given to the directional antenna.
Figure 10:
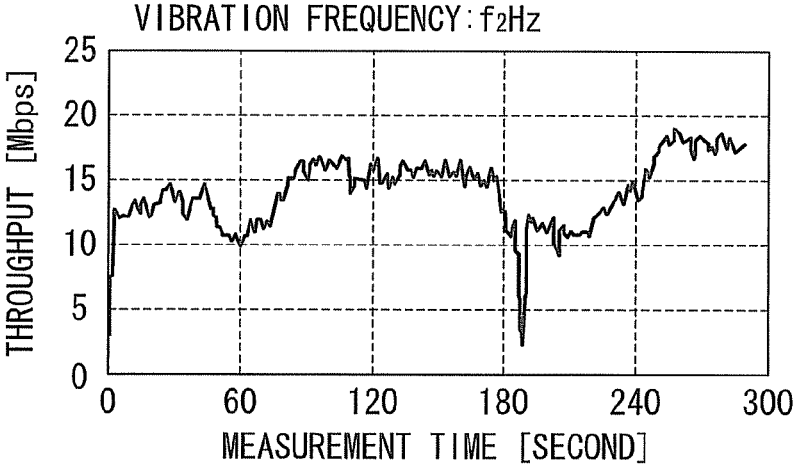
FIG. 10 is a graph showing the relation between throughput and measurement time when a test was performed with vibration of $f_2$ Hz given to the directional antenna.

In this test system, the distance between the two planar antennas 1, 2 was set to 50 cm, the amplitude of the other planar antenna 2 was set to 1.5 mm, the transmission data size was set to 1400 bytes, the link rate was set to be automatic, the transmission direction was set to be down (access point to client), and the measurement time was set to 300 seconds. Then, a test was performed, vibrating the antenna in three patterns of no vibration, vibration frequency: $f_1$ Hz and vibration frequency: $f_2$ Hz. The result is shown in FIGS. 8 to 10. Since the actual vibration frequency differs with the various conditions such as a use environment of the moving body 12, the test was performed in three patterns set at random.

In the result of this test, when there is no vibration, the throughput was kept constant as shown in FIG. 8, and favorable communication quality was maintained. When the vibration was $f_1$ Hz, the throughput was kept in a low state for about 170 seconds from the beginning of the test and thereafter became inconstant and unstable suddenly as shown in FIG. 9, and favorable communication quality was not maintained. When the vibration was $f_2$ Hz, the throughput was inconstant and unstable from the beginning of the test as shown in FIG. 10, and favorable communication quality was not maintained.

As is apparent from this test result, it is ideal and preferable that the planar antenna 2 does not vibrate. However, as the moving body moves, the planar antenna 2 inevitably vibrates, and a no-vibration state cannot be assumed. Also, in the case of vibration frequency: $f_2$ Hz, the throughput was inconstant and unstable from the beginning of the test. In the case of vibration frequency: $f_1$ Hz, the throughput was kept low for about 170 seconds from the beginning and thereafter became inconstant and unstable. As is apparent from this, when the planar antenna 2 vibrates at vibration frequency around $f_2$ Hz, communication quality will be significantly degraded.

In such a manner, when the antenna suffers high frequency vibration, communication quality will be degraded due to the packet configuration, etc.

Meanwhile, the test was performed here, vibrating the antenna in the three vibration frequency patterns, but it is preferable to do a test, vibrating the antenna in multiple vibration frequency patterns. By doing so, vibration frequency that has an adverse impact on communication quality is specified in accordance with the characteristics of each antenna, and the characteristics of the elastic member 29 of the damping mechanism 23 are set so that the vibration frequency of the antenna may be lower than the aforementioned vibration frequency.

In this manner, when a member having characteristics of absorbing high frequency vibration of each of the directional antennas 17 and 18 that makes changes in amplitude or frequency of a transmission signal from the aforementioned leaky transmission line 14 to the extent of inducing a demodulation error when the transmission signal is received at each of the directional antennas 17 and 18 as an antenna main body is used for the elastic member 29, degradation of communication quality can be prevented.

Industrial Applicability

Figure 11:
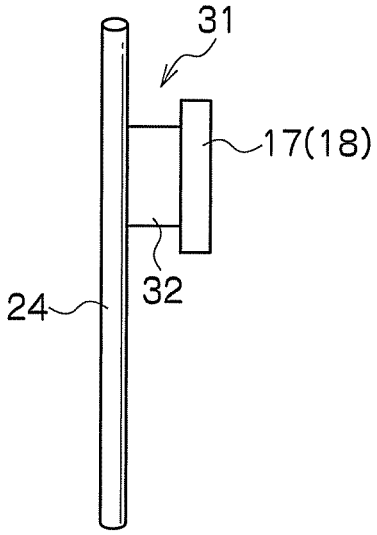
FIG. 11 is a side view showing the communication antenna device according to a first modification example of the present invention.
Figure 12:
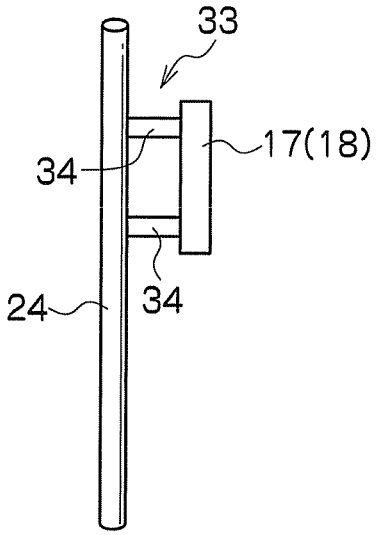
FIG. 12 is a side view showing the communication antenna device according to a second modification example of the present invention.

Although an illustrative constitution shown in FIG. 1 has been explained as the damping mechanism 23 in the aforementioned embodiment, the damping mechanism 23 of the present invention is not limited to this but may be constituted as shown in FIGS. 11 and 12. A damping mechanism 31 in FIG. 11 is constituted by a solid elastic member 32 whose side surface is formed in a rectangular shape provided between the base side member 24 and each of the directional antennas 17 and 18. For this elastic member 32, a material similar to one for the elastic member 29 in the aforementioned embodiment can be used.

A damping mechanism 33 in FIG. 12 is constituted to be supported at two points by two elastic members 34 each of whose side surfaces is formed in a bar shape provided between the base side member 24 and each of the directional antennas 17 and 18. For this elastic member 34, a material similar to one for the elastic member 29 in the aforementioned embodiment can be used.

Although the damping mechanism 23 is used to suppress vibration of each of the directional antennas 17 and 18 in the aforementioned embodiment, the damping mechanism 23 according to the present invention can be applied to all antennas whose vibration needs to be suppressed as well as the directional antennas 17 and 18.

Figure 13:
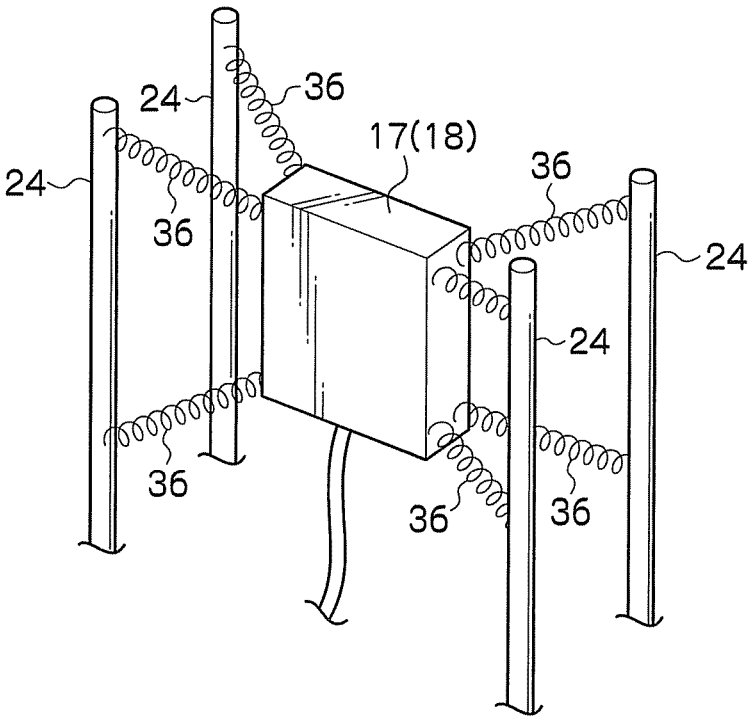
FIG. 13 is a side view showing the communication antenna device according to a third modification example of the present invention.

Also, as shown in FIG. 13, each of the directional antennas 17 and 18 may be elastically hung by elastic strings 36. The elastic strings 36 are supported by four base side members 24 and elastically support each of the directional antennas 17 and 18 from eight directions. Also, for the elastic strings 36, non-metallic coil springs or rubber strings that do not have an effect on electromagnetic waves are used. This can prevent high frequency vibration from being transmitted to each of the directional antennas 17 and 18. Meanwhile, the antenna may be supported by two base side members 24 and four or two elastic strings 36. This can elastically support each of the directional antennas 17 and 18.

Figure 14:
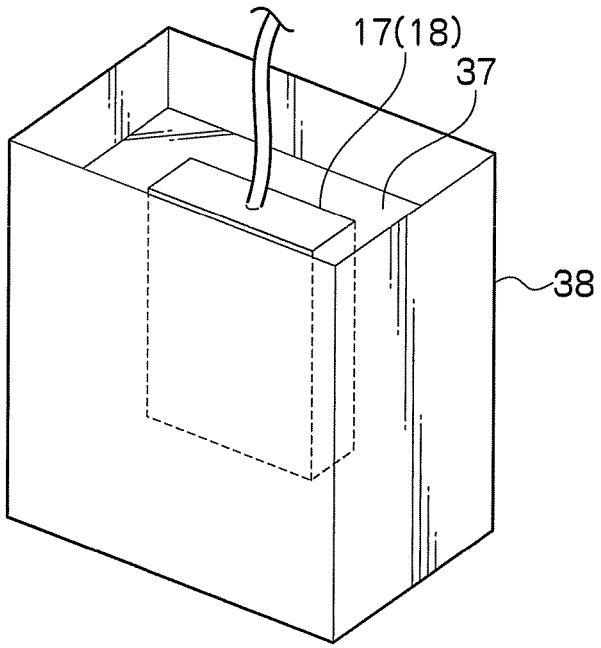
FIG. 14 is a side view showing the communication antenna device according to a fourth modification example of the present invention.

Also, as shown in FIG. 14, each of the directional antennas 17 and 18 may be buried in an elastic member 37. The elastic member 37 is filled in a container 38. As the elastic member 37, fluid such as gel or polymeric gel to be filled in the container 38, an elastic body such as a silicon rubber or the like can be used. Meanwhile, in a case of using an elastic body such as a silicon rubber, each of the directional antennas 17 and 18 may be supported directly without providing the container 38 in a state of covering the surrounding area of each of the directional antennas 17 and 18 with the silicon rubber or the like. In a case of using fluid such as gel or polymeric gel, this fluid will be filled in the container 38, and each of the directional antennas 17 and 18 will be soaked and hung in the fluid. In these cases, for the aforementioned elastic body or fluid, one having characteristics that do not have an effect on transmission of electromagnetic waves is used.

The invention claimed is:

1. A communication antenna device for radio communication, comprising:

an antenna main body of a first communication device that moves along a leaky transmission line of a second communication device in a radio communication system, the antenna main body configured to transmit and receive a signal to and from the leaky transmission line, wherein the first communication device moves relatively to a second communication device, and wherein the leaky transmission line is provided along a moving route of the first communication device;

a base side member of the communication device for supporting the antenna main body; and a damping mechanism provided between the base side member and the antenna main body, wherein the damping mechanism is configured to suppress high frequency vibration of the antenna main body that has an impact on radio communication in a radio wave radiation direction of the leaky transmission line, wherein the damping mechanism includes an elastic member configured to absorb high frequency vibration that has an impact on radio communication, wherein the elastic member sets, as a target frequency, the high frequency vibration of the antenna main body that makes changes of an interval between the leaky transmission line and the antenna main body causing a demodulation error in response to an amplitude or a frequency of the transmission signal being received at the antenna main body from the leaky transmission line, and wherein the elastic member has at least one characteristic of absorbing vibration with the target frequency or higher and not allowing vibration with higher vibration frequency than the target vibration frequency.

2. The communication antenna device according to claim 1, wherein the first communication device and the second communication device move relatively with a predetermined range of space from each other.

* * * * *